US008397797B2

(12) United States Patent
Piggott

(10) Patent No.: US 8,397,797 B2
(45) Date of Patent: Mar. 19, 2013

(54) LOW THERMAL STRAIN MULTI-COOLER

(75) Inventor: Alfred Piggott, Redford, MI (US)

(73) Assignee: DENSO International America, Inc., Southfield, MI (US)

( * ) Notice: Subject to any disclaimer, the term of this patent is extended or adjusted under 35 U.S.C. 154(b) by 385 days.

(21) Appl. No.: 12/751,056

(22) Filed: Mar. 31, 2010

(65) Prior Publication Data

US 2011/0240275 A1 Oct. 6, 2011

(51) Int. Cl.
*F28F 9/26* (2006.01)

(52) U.S. Cl. ..... 165/81; 165/140; 165/144; 165/175

(58) Field of Classification Search ..... 165/81–83, 165/144, 173, 175
See application file for complete search history.

(56) References Cited

U.S. PATENT DOCUMENTS

| | | | | | |
|---|---|---|---|---|---|
| 1,326,277 | A | * | 12/1919 | Latourelle | 165/82 |
| 1,808,619 | A | * | 6/1931 | Uhde | 165/83 |
| 2,549,093 | A | * | 4/1951 | Huber | 165/81 |
| 2,961,221 | A | * | 11/1960 | Friese et al. | 165/83 |
| 4,296,805 | A | * | 10/1981 | Fleury | 165/175 |
| 4,977,956 | A | * | 12/1990 | Aoki et al. | 165/175 |
| 5,095,972 | A | * | 3/1992 | Nakaguro | 165/175 |
| 5,247,991 | A | * | 9/1993 | Polcer | 165/145 |
| 5,954,123 | A | | 9/1999 | Richardson | |
| 6,142,218 | A | * | 11/2000 | Nilsson et al. | 165/82 |
| 6,179,043 | B1 | * | 1/2001 | Betz | 165/41 |
| 6,394,176 | B1 | | 5/2002 | Marsais | |
| 6,793,012 | B2 | | 9/2004 | Fang et al. | |
| 6,942,023 | B2 | | 9/2005 | Fang et al. | |
| 7,059,393 | B2 | | 6/2006 | Fang et al. | |
| 7,096,932 | B2 | | 8/2006 | Scoville et al. | |
| 7,360,584 | B2 | | 4/2008 | Hunzinger et al. | |
| 7,506,683 | B2 | | 3/2009 | Hu | |
| 7,527,087 | B2 | | 5/2009 | Desai et al. | |
| 7,552,756 | B2 | * | 6/2009 | Riniker et al. | 165/173 |
| 7,640,970 | B2 | * | 1/2010 | Kim et al. | 165/144 |
| 2005/0257914 | A1 | | 11/2005 | Huang | |

* cited by examiner

*Primary Examiner* — Leonard R Leo
(74) *Attorney, Agent, or Firm* — Harness, Dickey & Pierce, P.L.C.

(57) ABSTRACT

A heat exchanger with multi-flow capabilities includes a pair of intermediate tanks located between a pair of header tanks. An open gap is provided between the two intermediate tanks. A first plurality of tubes extend between the header tanks. A second plurality of tubes extend between one of the header tanks and one of the intermediate tanks. A third plurality of tubes extend between the other header tank and the other intermediate tank. In a two flow system, the two intermediate tanks are in fluid communication through a flexible jumper tube. In a three flow system the two intermediate tanks are isolated from each other. The open gap between the intermediate tanks allows for the uneven heat expansion between the various fluid flows.

19 Claims, 5 Drawing Sheets

LOW THERMAL STRAIN MULTI-COOLER

FIELD

The present disclosure relates to a heat exchanger. More particularly, the present disclosure relates to a multi-cooling heat exchanger for cooling two or more fluids while reducing the strain on the heat exchanger which occurs due to the different temperatures of the two or more fluids.

BACKGROUND

This section provides background information related to the present disclosure which is not necessarily prior art.

The conventional multi-cooling heat exchanger includes a core portion having a plurality of tubes, a header tank attached to both ends of the tubes, a plurality of fins disposed between adjacent tubes and an insert or side plate that provides stability to the heat exchanger. The header tanks are separated along their length to provide two or more separate cooling sections for the heat exchanger. A first fluid flows through the first section of the header tanks and tubes and a second fluid flows through the second section of the header tanks and tubes. Typical examples of the first fluid is refrigerant from an air conditioning system and a typical example for the second fluid is transmission oil. Both fluids are cooled as they pass through the plurality of tubes.

These multi-cooler heat exchangers develop a high amount of thermal strain. This is due to one of the fluids having a higher operating temperature than the other fluid. This temperature difference leads to a higher thermal expansion in the cooling section which cools the higher temperature fluid. Since both sections of the tubes are constrained by the header tanks, thermal strain occurs.

To alleviate this thermal strain, it is known to saw cut one or both of the header tanks to allow the higher temperature fluid section to expand freely and reduce the thermal strain. This method is effective but it adds labor and production time to the process. Another method for reducing this thermal strain is to make a saw cut in the insert or side plate. During cold weather operation, the plurality of tube expand due to increased temperature and the insert or side plate tends to heat up at a slower rate which causes a second source of thermal strain. The saw cut in the insert or side plate reduces this thermal strain but it still requires additional labor and production time.

SUMMARY

This section provides a general summary of the disclosure, and is not a comprehensive disclosure of its full scope or all of its features.

The present disclosure allows for the cooling of two or more fluids which flow in parallel through different sections of the plurality of tubes. The thermal strain is reduced in the present disclosure by providing intermediate tanks between the two header tanks. The two tanks are spaced from each other to define an open gap between them which allows for the difference in thermal expansion of the different sections of the heat exchanger.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
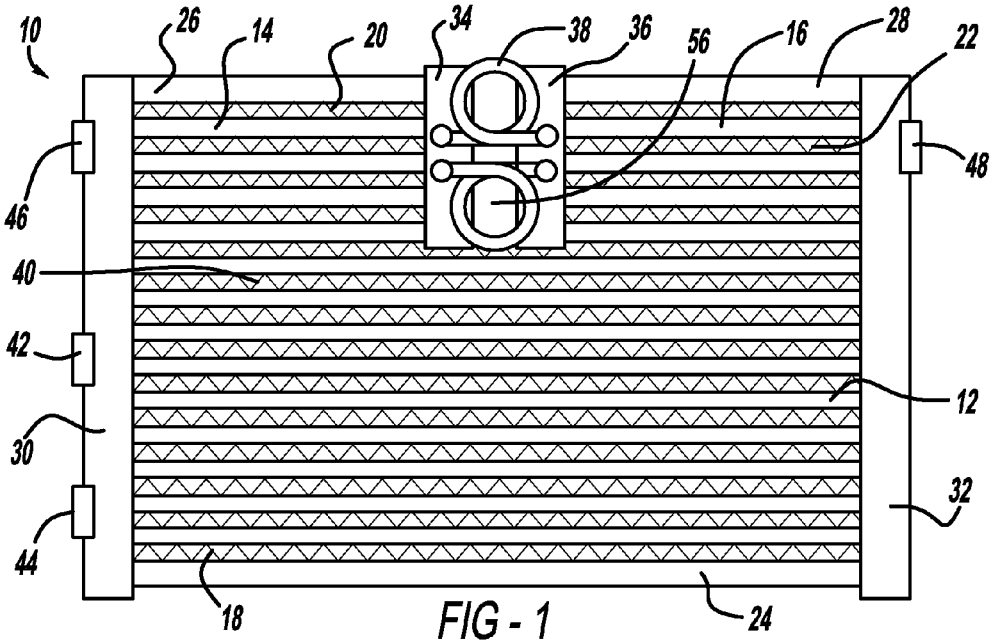
FIG. 1 is a front view of a heat exchanger in accordance with the present disclosure.
Figure 2:
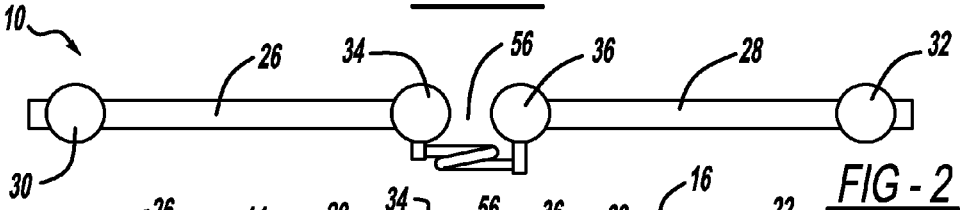
FIG. 2 is a top view of the heat exchanger illustrated in FIG. 1.

Example embodiments will now be described more fully with reference to the accompanying drawings. Referring now to FIGS. 1 and 2, a heat exchanger 10 in accordance with the present disclosure is illustrated. Heat exchanger 10 comprises a first plurality of tubes 12, a second plurality of tubes 14, a third plurality of tubes 16, a first plurality of fins 18, a second plurality of fins 20, a third plurality of fins 22, a first side plate 24, a second side plate 26, a third side plate 28, a first header tank 30, a second header tank 32, a first intermediate tank 34, a second intermediate tank 36 and one or more flexible jumper tubes 38.

Figure 10A:
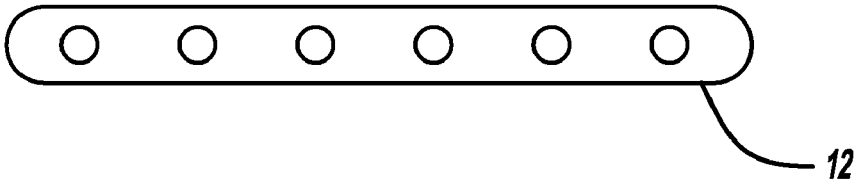
FIGS. 10A-10C illustrate the fluid passages in the tubes of the heat exchanger.
Figure 10B:
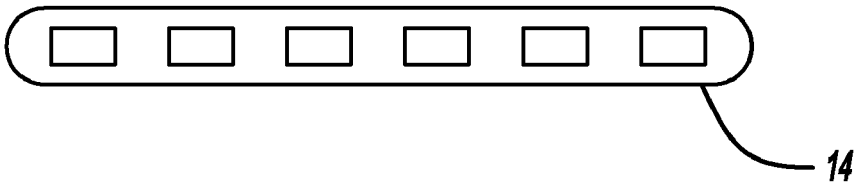
Figure 10C:
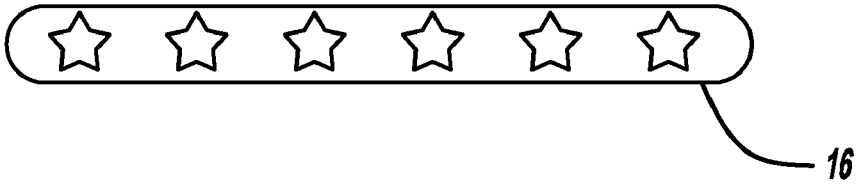

Each of the first, second and third plurality of tubes 12, 14, 16 are arranged in parallel to each other and each tube is flat so that the direction of the air flow (perpendicular to the page in FIG. 1) coincides with the longer portion of the flat tube. The flat surfaces of the first, second and third plurality of tubes 12, 14, 16 are coupled with the first, second and third plurality of fins 18, 20, 22 as illustrated in FIG. 1. Each of the first, second and third plurality of tubes define one or more internal passages through which fluid flows. The shape of each internal passage can be rectangular, round, oval, star shaped or any other shape. Also, the shape of the passages in the first, second and third plurality of tubes can be different from each other. As illustrated in FIGS. 10A-10C, tubes 12 have a circular shape, tubes 14 have a rectangular shape and tubes 16 have a star shape. The plurality of fins 18, 20, 22 increase the transfer area with the air to promote the heat exchange between the fluid within the plurality of tubes 12, 14, 16 and the air. The substantially rectangular heat exchanging unit including the plurality of tubes 12, 14, 16 and the plurality of fins 18, 20 and 22 is hereinafter referred to as core portion 40.

First and second header tanks 30 and 32 extend in the stacking direction of the plurality of tubes 12, 14, 16 and the plurality of fins 18, 20, 22 perpendicular to the length of the plurality of tubes 12, 14, 16. First header tank 30 includes a first inlet 42, a first outlet 44 and a second outlet 46. A first internal baffle (not shown) separates first inlet 42 from first outlet 44 and a second baffle (not shown) separates first inlet 42 from second outlet 46. Second header tank 32 includes a second inlet 48. A third internal baffle separates second inlet 48 from the lower portion of second header tank 32. First and second intermediate tanks 34 and 36 are disposed adjacent each other as shown in FIGS. 1 and 2. An open gap 56 extends entirely between first intermediate tank 34 and second intermediate tank 36 to allow for the expansion of the second and the third plurality of tubes 14, 16 with respect to the first plurality of tubes 12 as discussed below. The one or more flexible jumper tubes 38 extend between first intermediate tank 34 and second intermediate tank 36 to channel fluid flow between intermediate tanks 34 and 36.

First side plate 24 extends along the lower end of the first plurality of fins 18. Second side plate 26 extends along the upper end of the second plurality of fins 20. Third side plate 28 extends along the upper end of the third plurality of fins 22. First, second and third side plates 24, 26 and 28 provide support for core portion 40.

The first plurality of tubes 12 are in fluid communication with first and second header tanks 30 and 32. The second plurality of tubes 14 are in fluid communication with first header tank 30 and first intermediate tank 34. The third plurality of tubes 16 are in fluid communication with the second intermediate tank 36 and the second header tank 32. As discussed above, first intermediate tank 34 is in fluid communication with second intermediate tank 36 through the one or more flexible jumper tubes 38 illustrated in FIGS. 1 and 2 as a tubular coil.

Thus, heat exchanger 10 defines two heat exchanging sections which have different fluids flowing through the sections. In the lower section, a first fluid is introduced into first inlet 42 into first header tank 30. The first fluid flows from first header tank 30 through a portion of the first plurality of tubes 12 to second header tank 32 where the first fluid makes a turn and returns to first header tank 30 through the other portion of the first plurality of tubes 12 and leaves first header tank 30 through first outlet 44. In the upper section, a second fluid, different from the first fluid, is introduced into second inlet 48 into second header tank 32. The second fluid flows from second header tank 32 through the second plurality of tubes 14 and into first intermediate tank 34, through the one or more flexible jumper tubes 38 into second intermediate tank 36. The second fluid flows from second intermediate tank 36 through the third plurality of tubes 16 and into first header tank 30 and leaves first header tank 30 through second outlet 46.

If the temperature of the second fluid is higher than the temperature of the first fluid the differences in the thermal expansion of the plurality of tubes 12, 14, 16 is compensated for by open gap 56 which reduces and/or eliminates the thermal strain which could occur due to the differences in thermal expansion of the plurality of tubes 12, 14, 16. The one or more flexible jumper tubes 38 permit the movement between first intermediate tank 34 and second intermediate tank 36.

Figure 3:
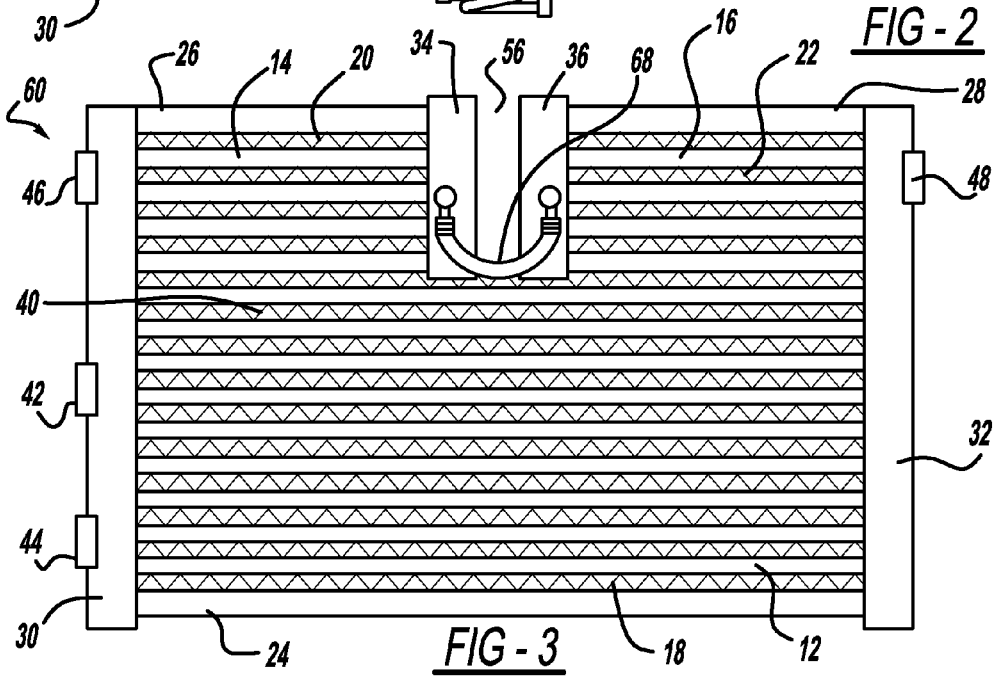
FIG. 3 is a front view of a heat exchanger in accordance with another embodiment of the present invention.

Referring now to FIG. 3, a heat exchanger 60 in accordance with another embodiment of the present disclosure is illustrated. Heat exchanger 60 is the same as heat exchanger 10 except that the one or more flexible jumper tubes 38 have been replaced by one or more rubber jumper hoses 68 which are in fluid communication with first and second intermediate tanks 34 and 36. The above description of heat exchanger 10 applies to heat exchanger 60 also.

Figure 4:
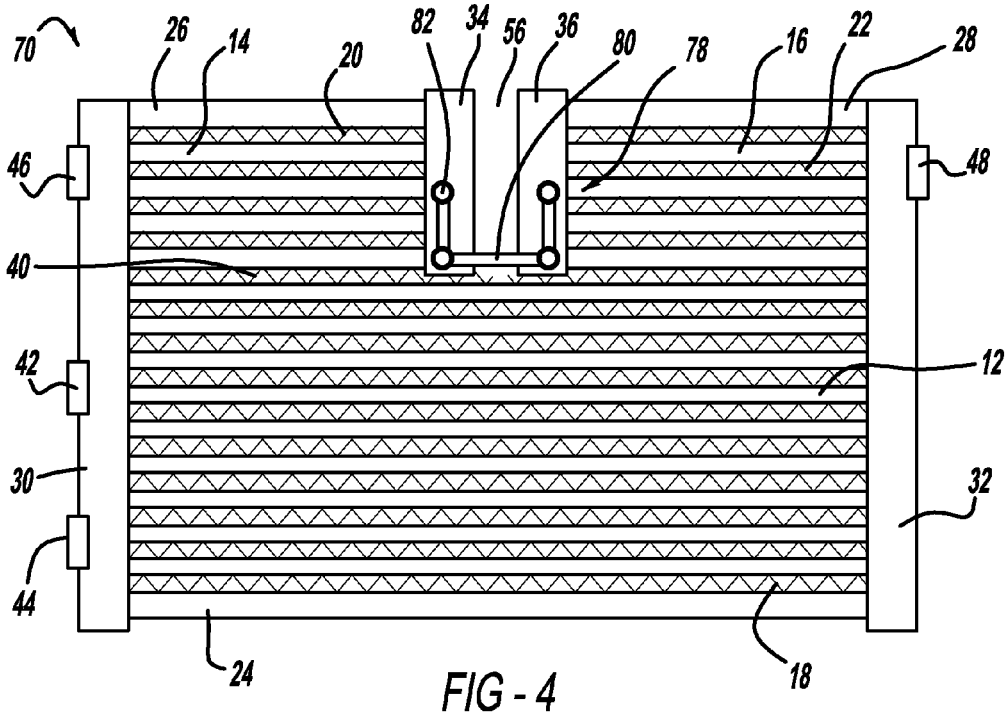
FIG. 4 is a front view of a heat exchanger in accordance with another embodiment of the present invention.

Referring now to FIG. 4, a heat exchanger 70 in accordance with another embodiment of the present disclosure is illustrated. Heat exchanger 70 is the same as heat exchanger 10 except that the one or more flexible jumper tubes 38 have been replaced by jumper tube assembly 78 which is in fluid communication with first and second intermediate tanks 34 and 36. Jumper tube assembly 78 includes a plurality of tubes 80 each of which are connected to another tube 80 or to first and second intermediate tanks 34 and 36 through a plurality of rotating quick connectors 82. The above description of heat exchanger 10 applies to heat exchanger 70.

Figure 5:
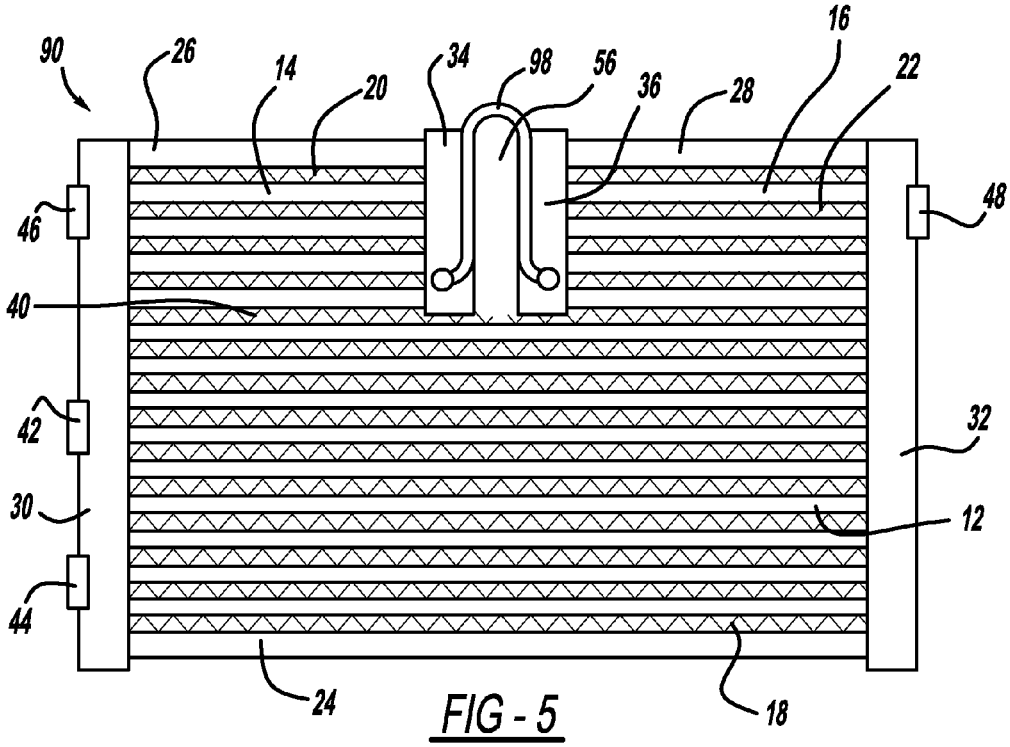
FIG. 5 is a front view of a heat exchanger in accordance with another embodiment of the present invention.

Referring now to FIG. 5, a heat exchanger 90 in accordance with another embodiment of the present disclosure is illustrated. Heat exchanger 90 is the same as heat exchanger 10 except that the one or more flexible jumper tubes 38 have been replaced by one or more generally U-shaped jumper tubes 98 which are in fluid communication with first and second intermediate tanks 34 and 36. The above description of heat exchanger 10 applies to heat exchanger 90.

Figure 6:
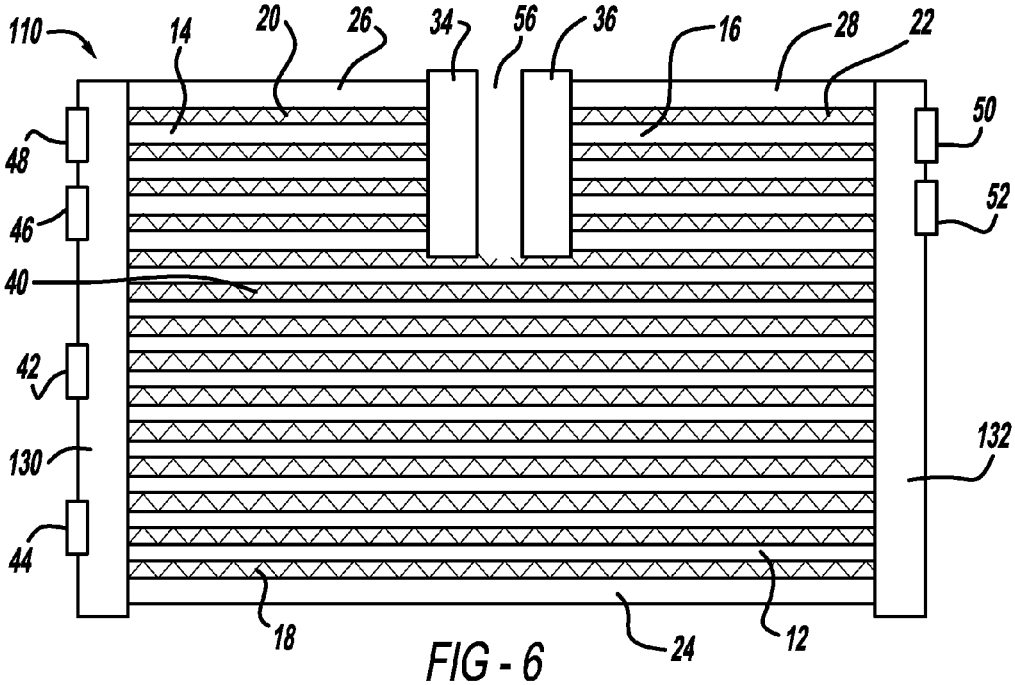
FIG. 6 is a front view of a heat exchanger in accordance with another embodiment of the present invention.

Referring now to FIG. 6, a heat exchanger 110 in accordance with the present disclosure is illustrated. Heat exchanger 110 comprises the first plurality of tubes 12, the second plurality of tubes 14, the third plurality of tubes 16, the first plurality of fins 18, the second plurality of fins 20, the third plurality of fins 22, the first side plate 24, the second side plate 26, the third side plate 28, a first header tank 130, a second header tank 132, the first intermediate tank 34 and the second intermediate tank 36.

Each of the first, second and third plurality of tubes 12, 14, 16 are arranged in parallel to each other and each tube is flat so that the direction of the air flow (perpendicular to the page in FIG. 1) coincides with the longer portion of the flat tube. The flat surface of the first, second and third plurality of tubes 12, 14, 16 are coupled with the first, second and third plurality of fins 18, 20, 22 as illustrated in FIG. 6. The plurality of fins 18, 20, 22 increase the transfer area with the air to promote the heat exchange between the fluid within the plurality of tubes 12, 14, 16 and the air. The substantially rectangular heat exchanging unit including the plurality of tubes 12, 14, 16 and the plurality of fins 18, 20 and 22 is hereinafter referred to as core portion 40.

First and second header tanks 130 and 132 extend in the stacking direction of the plurality of tubes 12, 14, 16 and the plurality of fins 18, 20, 22 perpendicular to the length of the plurality of tubes 12, 14, 16. First header tank 130 includes first inlet 42; first outlet 44, second outlet 46, and second inlet 48. A first internal baffle (not shown) separates first inlet 42 from first outlet 44, a second baffle (not shown) separates first inlet 42 from second outlet 46 and a third internal baffle separates second outlet 46 from second inlet 48. Second header tank 132 includes a third inlet 50 and a third outlet 52. An internal baffle (not shown) separates third inlet 50 from third outlet 52. First and second intermediate tanks 34 and 36 are disposed adjacent each other as shown in FIGS. 1 and 2. Open gap 56 extends entirely between first intermediate tank 34 and second intermediate tank 36 to allow for the expansion of the second and third plurality of tubes 14, 16 with respect to the first plurality of tubes 12 as discussed below. There is no fluid flow between first intermediate tank 34 and second intermediate tank 36.

First side plate 24 extends along the lower end of the first plurality of fins 18. Second side plate 26 extends along the upper end of the second plurality of fins 20. Third side plate 28 extends along the upper end of the third plurality of fins 22. First, second and third side plates 24, 26 and 28 provide support for core portion 40.

The first plurality of tubes 12 are in fluid communication with first and second header tanks 130 and 132. The second plurality of tubes 14 are in fluid communication with first header tank 130 and first intermediate tank 34. The third plurality of tubes 16 are in fluid communication with the second intermediate tank 36 and the second header tank 132. As discussed above, first intermediate tank 34 is not in fluid communication with second intermediate tank 36.

Thus, heat exchanger 10 defines three heat exchanging sections which have different fluids flowing through the sections. In the lower section, a first fluid is introduced into first inlet 42 into first header tank 130. The first fluid flows from first header tank 130 through a portion of the first plurality of tubes 12 to second header tank 132 where the first fluid makes a U-turn and returns to first header tank 130 through the other portion of the first plurality of tubes 12 and leaves first header tank 130 through first outlet 44. In one of the upper sections, a second fluid, different from the first fluid, is introduced into second inlet 48 into first header tank 130. The second fluid flows from first header tank 130 through a portion of the second plurality of tubes 14 and into first intermediate tank 34 where the second fluid makes a U-turn and returns to first header tank 130 through the other portion of the second plurality of tubes 14 and leaves first header tank 130 through second outlet 46. In the other of the upper sections, a third fluid, different than the first and second fluids, is introduced into third inlet 50 into second header tank 132. The third fluid flows from second header tank 132 through a portion of the third plurality of tubes 16 and into second intermediate tank 36 where the third fluid makes a U-turn and returns to the second header tank 132 through the other portion of the third plurality of tubes 16 and leaves second header tank 132 through third outlet 52.

If the temperature of the second fluid and/or the third fluid is higher than the temperature of the first fluid the differences in the thermal expansion of the plurality of tubes 12, 14, 16 is compensated for by open gap 56 which reduces and/or eliminates the thermal strain which could occur due to the differences in thermal expansion of the plurality of tubes 12, 14, 16.

Figure 7:
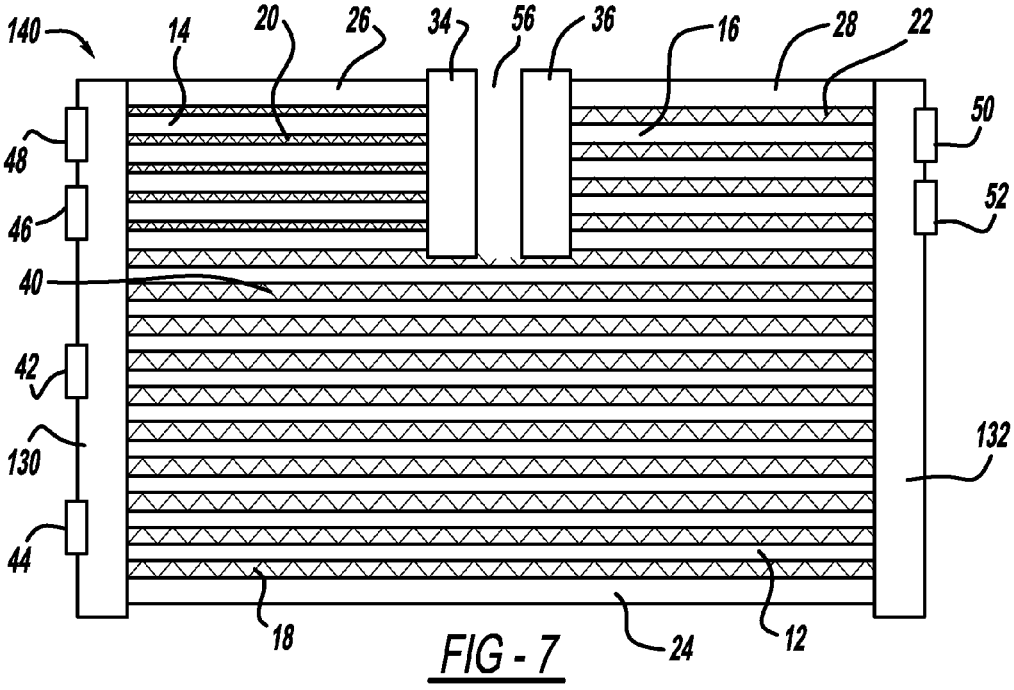
FIG. 7 is a front view of a heat exchanger in accordance with another embodiment of the present invention.

Referring now to FIG. 7, a heat exchanger 140 in accordance with the present disclosure is illustrated. Heat exchanger 140 is the same as heat exchanger 110 except that the pitch of the second plurality of fins 20 is different than the pitch of the first and third plurality of fins 18 and 22. While only the pitch of the second plurality of fins 18 is illustrated as being different, each of the first, second and third plurality of fins 18, 20 and 22 could have different pitches. The above description of heat exchanger 110 applies to heat exchanger 140 also.

Figure 8:
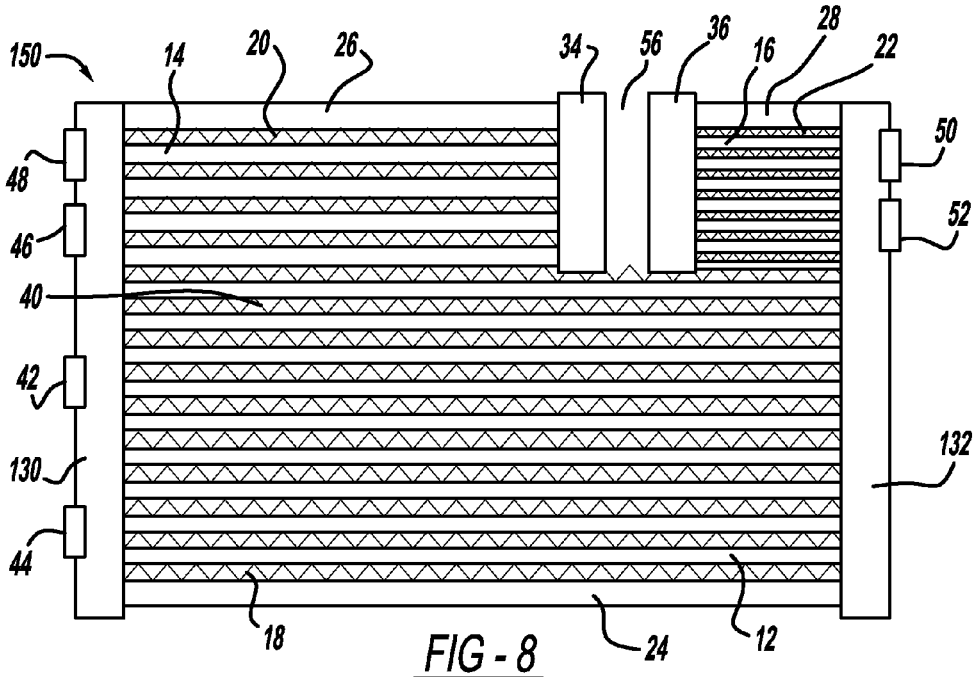
FIG. 8 is a front view of a heat exchanger in accordance with another embodiment of the present invention.

Referring now to FIG. 8, a heat exchanger 150 in accordance with the present disclosure is illustrated. Heat exchanger 150 is the same as heat exchanger 110 except that the length of the second plurality of tubes 14 and the second plurality of fins 20 is different than the length of the third plurality of tubes 16 and the third plurality of fins 22. In addition, the thickness of the second plurality of tubes 14 is different than the thickness of the third plurality of tubes 16. The above description of heat exchanger 110 applies to heat exchanger 150 also.

Figure 9:
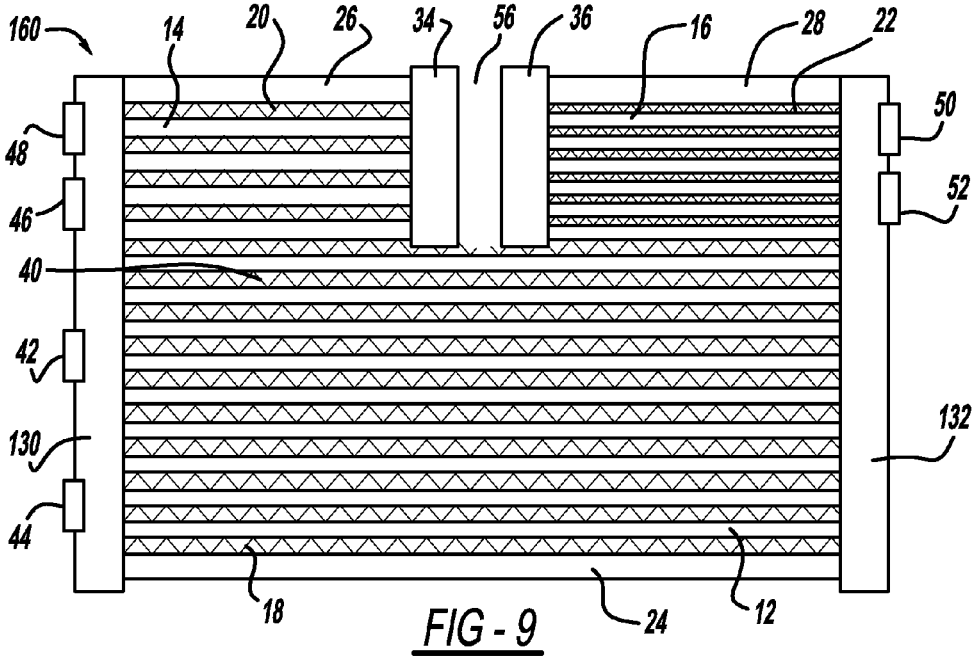
FIG. 9 is a front view of a heat exchanger in accordance with another embodiment of the present invention.

Referring now to FIG. 9, a heat exchanger 160 in accordance with the present disclosure is illustrated. Heat exchanger 160 is the same as heat exchanger 110 except that the pitch of the second plurality of tubes 14 is different than the pitch of the third plurality of tubes 16. In addition, the thickness of the second plurality of tubes 14 is different than the thickness of the third plurality of tubes 16. The above description of heat exchanger 110 applies to heat exchanger 160 also.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A heat exchanger comprising:

a first header tank;

a second header tank;

a first intermediate tank disposed between said first header tank and said second header tank;

a second intermediate tank disposed between said first header tank and said second header tank, an open gap being defined between said first and second intermediate tanks;

a first plurality of tubes extending between said first and second header tanks, said first plurality of tubes being in fluid communication with said first and second header tanks;

a second plurality of tubes extending between said first header tank and said first intermediate tank, said second plurality of tubes being in fluid communication with said first header tank and said first intermediate tank;

a third plurality of tubes extending between said second header tank and said second intermediate tank, said third plurality of tubes being in fluid communication with said second header tank and said second intermediate tank; and a generally U-shaped jumper tube disposed between said first and second intermediate tanks, said generally U-shaped jumper tube being in fluid communication with said first and second intermediate tanks wherein said second and third plurality of tubes are not in fluid communication with said first plurality of tubes.

2. The heat exchanger according to claim 1, wherein said first intermediate tank is in fluid communication with said second intermediate tank.

3. The heat exchanger according to claim 1, wherein said generally U-shaped tube forms a flexible jumper tube disposed between said first and second intermediate tanks.

4. A heat exchanger comprising:

a first header tank;

a second header tank;

a first intermediate tank disposed between said first header tank and said second header tank;

a second intermediate tank disposed between said first header tank and said second header tank, an open gap being defined between said first and second intermediate tanks;

a first plurality of tubes extending between said first and second header tanks, said first plurality of tubes being in fluid communication with said first and second header tanks;

a second plurality of tubes extending between said first header tank and said first intermediate tank, said second plurality of tubes being in fluid communication with said first header tank and said first intermediate tank;

a third plurality of tubes extending between said second header tank and said second intermediate tank, said third plurality of tubes being in fluid communication with said second header tank and said second intermediate tank; and a tubular coil disposed between said first and second intermediate tanks, said tubular coil being in fluid communication with said first and second intermediate tanks;

wherein said second and third plurality of tubes are not in fluid communication with said first plurality of tubes.

5. A heat exchanger comprising:

a first header tank;

a second header tank;

a first intermediate tank disposed between said first header tank and said second header tank;

a second intermediate tank disposed between said first header tank and said second header tank, an open gap being defined between said first and second intermediate tanks;

a first plurality of tubes extending between said first and second header tanks, said first plurality of tubes being in fluid communication with said first and second header tanks;

a second plurality of tubes extending between said first header tank and said first intermediate tank, said second plurality of tubes being in fluid communication with said first header tank and said first intermediate tank;

a third plurality of tubes extending between said second header tank and said second intermediate tank, said third plurality of tubes being in fluid communication with said second header tank and said second intermediate tank; and a rubber jumper hose disposed between said first and second intermediate tanks, said rubber jumper hose being in fluid communication with said first and second intermediate tanks.

6. The heat exchanger according to claim 1, wherein said generally U-shaped tube forms a jumper tube assembly disposed between said first and second intermediate tanks.

7. A heat exchanger comprising:

a first header tank;

a second header tank;

a first intermediate tank disposed between said first header tank and said second header tank;

a second intermediate tank disposed between said first header tank and said second header tank, an open gap being defined between said first and second intermediate tanks;

a first plurality of tubes extending between said first and second header tanks, said first plurality of tubes being in fluid communication with said first and second header tanks;

a second plurality of tubes extending between said first header tank and said first intermediate tank, said second plurality of tubes being in fluid communication with said first header tank and said first intermediate tank;

a third plurality of tubes extending between said second header tank and said second intermediate tank, said third plurality of tubes being in fluid communication with said second header tank and said second intermediate tank; and a jumper tube assembly disposed between said first and second intermediate tanks, said jumper tube assembly being in fluid communication with said first and second intermediate tanks;

wherein said jumper tube assembly comprises a plurality of tubes and a plurality of rotating quick connectors.

8. The heat exchanger according to claim 1, wherein different fluids flow through said first and second plurality of tubes.

9. The heat exchanger according to claim 1, wherein said second plurality of tubes are longer than said third plurality of tubes.

10. The heat exchanger according to claim 9, wherein said second plurality of tubes have a different tube size than said third plurality of tubes.

11. The heat exchanger according to claim 10, wherein said second plurality of tubes have a different tube pitch than said third plurality of tubes.

12. The heat exchanger according to claim 9, wherein said second plurality of tubes have a different tube pitch than said third plurality of tubes.

13. The heat exchanger according to claim 1, wherein said second plurality of tubes have a different tube size than said third plurality of tubes.

14. The heat exchanger according to claim 13, wherein said second plurality of tubes have a different tube pitch than said third plurality of tubes.

15. The heat exchanger according to claim 1, wherein said second plurality of tubes have a length equal to a length of said third plurality of tubes.

16. The heat exchanger according to claim 15, wherein said second plurality of tubes have a different tube size than said third plurality of tubes.

17. The heat exchanger according to claim 16, wherein said second plurality of tubes have a different tube pitch than said third plurality of tubes.

18. The heat exchanger according to claim 15, wherein said second plurality of tubes have a different tube pitch than said third plurality of tubes.

19. The heat exchanger according to claim 1, wherein different fluids flow through said first, second and third plurality of tubes.

* * * * *